US005389274A

United States Patent [19]

Fernandez

[11] Patent Number: 5,389,274

[45] Date of Patent: Feb. 14, 1995

[54] ACTIVATOR-FROTHER COMPOSITION

[75] Inventor: Hector C. Fernandez, Santiago, Chile

[73] Assignee: Hecu S.A., Santiago, Chile

[21] Appl. No.: 140,578

[22] Filed: Oct. 21, 1993

[30] Foreign Application Priority Data

Oct. 23, 1992 [CL] Chile ..... 1195-92

[51] Int. Cl.[6] ..... B03D 1/02

[52] U.S. Cl. ..... 252/61

[58] Field of Search ..... 252/61; 209/166, 167; B03D 1/02

[56] References Cited

U.S. PATENT DOCUMENTS 1,988,052 6/1935 Schafer ..... 252/61

2,082,383 6/1937 Corbett ..... 252/61

*Primary Examiner*—Mark L. Bell

*Assistant Examiner*—Paul Marcantoni

*Attorney, Agent, or Firm*—Rosenman & Colin

[57] ABSTRACT

An activator-frother composition of good selectivity which can be used as additional reagent for the flotation of minerals of finely ground sulfide type and as sole reagent in the treatment of flotation tailings, which consists of about 1% to 10% by weight of pine oil, about 10% to 30% by weight of sodium sulfide, about 20% to 40% by weight of sodium bicarbonate. The composition has the advantage of requiring little time of homogenization and conditioning in order to be sufficiently soluble, to be stable within a wide pH range, and not to be contaminating.

9 Claims, No Drawings

ACTIVATOR-FROTHER COMPOSITION

SPECIFICATION

The present invention relates to an activator-frother composition of good selectivity which can be used as additional reagent for the flotation of minerals of finely ground sulfide type as well as in the retreatment of flotation plant tailings, in which case it can be employed as sole reagent.

DESCRIPTION OF THE PRIOR ART

THE CONCENTRATION OF MINERALS IN THE MINING INDUSTRY

By concentration or processing of minerals there is understood the sequence of operations which is carried out with the product or ore of a deposit in order to concentrate or separate the desired mineral for the subsequent extraction of the valuable metal which it contains.

By definition, the operations involved in concentration do not change the chemical nature of the minerals contained in the ore. This characteristic constitutes the basic difference from alternative methods of treatment, such as hydrometallurigal processes. As the result of a concentration operation, a concentrate is obtained which is that fraction of the ore enriched with the minerals of economic value and a tailing which fundamentally contains minerals of no economic value. The latter are known as gangue or waste.

In general, the concentrating of minerals involves, as first step, the reduction in size of the ore in crushing and grinding steps so as to obtain suitable separation between the valuable minerals and the minerals of the gangue. The next step is the concentration proper, using different physical or physical-chemical processes depending on the characteristics of the minerals which are being processed. Finally, after suitable handling of the concentrate, it is ready for extraction of the valuable metal, which is traditionally effected by a pyrometallurgical process.

For purposes of concentration, the different methods used employ a physical or physical-chemical difference between the valuable minerals and those of the gangue. These differences may relate to the specific gravity (gravitational concentration), to surface properties (concentration by flotation), to magnetic properties (magnetic concentration), to properties of electrical conductivity (electrostatic concentration) or simply to an optical property (concentration by selection).

FLOTATION AS METHOD OF CONCENTRATION

Flotation is undoubtedly the most important and versatile method for the concentration of minerals. This process has permitted the treatment of ores of lower assays and more complicated composition, which otherwise would not have been economical. Furthermore, flotation has been successfully applied for the retreatment of rejects from other methods of concentration, or even in the processing of old tailings of flotation plants, due to the new advances and improvements which have been achieved with this technique.

Flotation is a selective process which can be used in order to obtain separation between the minerals of interest and those of the gangue, as well as for specific separations between valuable minerals in complex ores, such as copper-zinc, lead-zinc, etc. The process was initially developed in the treatment of minerals of sulfide type but, with time, its field of action has been extended to that of minerals of the oxide type and non-metallic minerals.

There is set forth below a list of minerals which can be recovered by flotation, but this list is merely representative of the large variety of minerals which can be concentrated by this method.

| SOME MINERALS RECOVERED BY FLOTATION | |
|---|---|
| Barium | Mercury |
| Barite ($BaSO_4$) | Cinnabar ($HgS$) |
| Calcium | Molybdenum |
| Calcite ($CaSO_4$) | Molybdenite ($MOS_2$) |
| Zinc | Gold |
| Sphalerite ($ZnS$) | Calaverite ($AuTe_2$) |
| Smithsonite ($ZnCO_3$) | Sylvanite ($Ag.Au)Te_2$ |
| Copper | Silver |
| Bornite ($2Cu_2S \cdot CuS \cdot FeS$) | Argentite ($AG_2S$) |
| Chalcopyrite ($CuFeS_2$) | Prustite ($Ag_3S_3As$) |
| Chalcosite ($Cu_2S$) | |
| Covellite ($CuS$) | |
| Iron | Lead |
| Hematite ($Fe_2O_3$) | Cerussite ($PbCO_3$) |
| Magnetite ($Fe_3O_4$) | Galena ($PbS$) |
| Pyrite ($FeS_2$) | |

The theory of flotation is complicated, all the mechanisms involved not even being fully understood. This method makes use of the different superficial physical-chemical properties of the minerals present in the ore. The particles of mineral finely ground and dispersed in a pulp (mixture of mineral and water) are treated with certain chemical reagents which, being selectively absorbed on the surface of some metals, impart to them properties of hydrophobicity or repellence to contact with water. In this way, if an aqueous phase is introduced into the pulp, such as bubbles of air, the hydrophobic particles will adhere to the bubbles and will be transported by them to the surface of the pulp. On the other hand, the rest of the mineral particles will be termed hydrophilic and will remain within the pulp.

The most important flotation reagents are the so-called collectors which are the reagents which impart the hydrophobic properties to given particles of mineral. However, for the success of the process, it is indispensable also to use reagents known as frothers which are responsible for maintaining reasonable stability in the mineralized froth which is formed on the surface of the pulp, and the use of reagents known as regulators which are responsible for activating or preventing the action of the collectors and of controlling the pH of the pulp (level of alkalinity or acidity).

COLLECTOR REAGENTS

Collectors are the organic compounds which are responsible for imparting hydrophobic properties to certain minerals, which takes place by the adsorption of molecules or ions of the reagent on the surface of the mineral. This absorption reduces the stability of the hydrated layer which separates the surface of the mineral from the bubble of air to an extent at which contact can be established. In aqueous solution, the collector molecules can dissociate into ions or be practically insoluble, in which case the hydrophobicity is obtained by covering the surface of the mineral with a thin film of the collector.

In general, the collectors are used in small amounts, sufficient to form a monomolecular layer on the surface of the mineral. A larger amount is an unnecessary, additional expense, in addition to promoting the flotation of other minerals, thereby reducing the selectivity of the concentration.

Ionic collectors are the ones which find the greatest use in flotation. These are heteropolar molecules of asymmetric structure. The non-polar hydrocarbon radical has a pronounced repellence to water, while the polar part reacts with the water and establishes some type of physical or chemical attraction with the surface of the mineral.

Among the ionic collectors, the group of anionic collectors and, in particular, those of the mercapto type, known as xanthates, are the typical collectors for the flotation of minerals of sulfide type. Representative types of these collectors are the following:

Potassium amylxanthate $C_5H_{11}-O-\overset{\overset{\displaystyle S}{\|}}{C}-S\ Na$ Sodium isopropylxanthate $C_3H_7-O-\overset{\overset{\displaystyle S}{\|}}{C}-S\ Na$ It is believed that the xanthates are absorbed on the surface of the minerals due to chemical reactions between the polar group and the surface, strongly hydrophobic insoluble metal xanthates being formed. Research in this field has shown that prior action of oxygen on the surface of the mineral favors the action of the collector, since great importance is attributed to the process of ion exchange between the xanthate and the oxidation products on the surface of the mineral. The xanthates are normally used in slightly alkaline pulps, since they decompose in acid medium, and in a very alkaline environment the hydroxyl ions (—OH) can displace the xanthate ions from the surface of the mineral.

The dithiophosphates are also important mercapto collectors although of less use than the xanthates. They are comparatively weaker than the latter but give good results when used together.

Cation collectors, among which the amines are the most common, are used for the flotation of minerals such as oxides and carbonates.

These collectors are very sensitive to the pH of the pulp, having greater activity in a slightly acid medium. Differing from what takes place with the xanthates, it is believed that the amines are absorbed fundamentally by electrostatic attractions between the polar part of the collector and the surface of the mineral. These forces are not as strong or irreversible as the chemical reactions of the anion reagents, so that their collector properties are weaker.

The hydroxyl collectors, among which the carboxylics or fatty acids are the most important, are used in the flotation of minerals such as the so-called non-metallics and nonferrous metal carbonates. The fatty acids are strong collectors but are of poor selectivity.

FROTHING REAGENTS

Subsequent to the hydrophobicity which the mineral has achieved by the action of a collector, the stability of the union with the bubble of air depends to a great extent on the efficiency of the reagents known as frothers.

Frothers are generally heteropolar organic compounds capable of being absorbed on the air-water interface, with the nonpolar part directed towards the gaseous phase, stabilizing the air bubble by a decrease in the surface tension.

The most effective frothers include one of the following groups in their composition:

| | |
|---|---|
| Hydroxyl group | —OH |
| Carboxyl group | $-C\begin{matrix}\diagup\!\!\!\!\diagup O \\ \diagdown OH\end{matrix}$ |
| Carbonyl group | —C=O |
| Amine group | $-NH_2$ |
| Sulfo group | $-OSO_2OH$<br>$-SO_2OH$ |

The reagents of alcohol type (with hydroxyl group) are the most used, since they have practically no collector properties, which property is recognized as desirable in a good frother in order not to interfere with the selectivity of the process. As examples, mention may be made of pine oil and cresylic acid, compounds having a base of aromatic alcohols.

A large number of synthetic frothers formed primarily of alcohols of high molecular weight are also used. The advantage of these reagents as compared with pine oil and cresylic acid is that they are more stable compounds, permitting better control in the process.

REGULATOR REAGENTS

The regulators or modifiers are used in flotation in order to modify the action of the collector, either intensifying or reducing the hydrophobic effect on the surface of the mineral. They are classified as activators, depressants and pH modifiers.

The activators change the chemical nature of the mineral surface in such a manner that the collector can be absorbed on said surface. Generally, they are soluble salts which ionize in aqueous solution, so that the ions are the ones which react with the mineral surface. One classical example is the activation of zinc sulfide (sphalerite) by copper ions in solution. Sphalerite floats deficiently with a collector of xanthate type since the zinc xanthate frothed on the surface is relatively soluble. The presence of copper ions leads to the formation of surface molecules of copper sulfide which react rapidly with the xanthate to form insoluble copper xanthate and, in this way, leave the surface with hydrophobic characteristics.

The depressants are used to increase the selectivity of the flotation, which is obtained by preventing the action of the collector on given minerals. The action of the depressants is generally more complicated and less understood, with the result that its control is more difficult as compared with the other reagents. By way of example, there may be mentioned the action of cyanides in the selective flotation of sulfides, such as sodium cyanide. This reagent can react with the metal xanthates formed on the mineral surface, giving rise to complexes of greater solubility and therefore making the action of the collector less effective.

The pH modifiers are used to regulate the level of alkalinity of acidity of the pulp, which also is an effective way of controlling the selectivity in the flotation. In general, it is possible to effect the flotations in slightly alkaline media since most of the collectors are stable under these conditions and furthermore the problems of corrosion in equipment and installations are reduced to a minimum. For alkaline pulps, lime is normally used and for acid pulps sulfuric acid is used.

DESCRIPTION OF THE INVENTION

GENERAL DESCRIPTION OF THE REAGENT OF THE INVENTION

The reagent of the invention can be classified as an activator-frother composition of good selectivity which can be employed as additional reagent for the flotation of minerals of finely ground sulfide type, approximately below mesh 150. Furthermore, it is applicable in the retreatment of flotation plant tailings, in which case it can be applied in practice as sole reagent. Being sufficiently soluble, it requires little time of homogenization or conditioning.

The reagent of the invention is stable within a wide pH range, although the best results have been obtained for pH values of between 6 and 7. Apparently, the action of the reagent of the invention is greatly improved in the presence of a suitable aeration of the pulp, which would explain the good results upon applying it in flotations in cascade system and in cells with intense agitation.

The reagent of the invention is a suitable combination of compounds which, to a greater or lesser extent, are related to the mining industry. They are pine oil, hydrogen peroxide, sodium bicarbonate and sodium sulfide, the descriptions and probable mechanisms of action of which are indicated below.

PINE OIL COMPONENT

Pine oil belongs to the category of frothing reagents used in flotation of minerals and, as such, is responsible for the stability of the froth phase in said process.

In general, the oil is a mixture of heteropolar organic compounds capable of being absorbed on the air-water interface. In aqueous solution, the dipoles of the water combine rapidly with the polar groups of the pine oil, but there is practically no reaction with the non-polar hydrocarbon group, and the tendency is to force the latter to the inside of the air phase. In this way, the action of this compound results in its absorption on the air-water interface, whereby the bubbles of air which transport the mineralized solid particles are suitably stabilized.

More specifically, pine oil is formed of a series of alcohols, the most important constituent of which is alphaterpineol. In the structure of this component, the hydroxyl group (—OH) is the polar part.

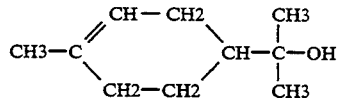

SODIUM SULFIDE COMPONENT

Sodium sulfide ($Na_2S$) belongs to the category of flotation reagents known as modifiers which, in general, alter the surface properties of the mineral particles for purposes of activation or depression.

One characteristic application of sodium sulfide has to do with the activation by sulfurization of oxidized minerals, with suitable regulation of the quantity added being required, since an excessive dose can act as depressant for a large number of sulfurized minerals; it is a common practice to float the sulfides first and then the oxides, with the addition in steps of sodium sulfide and a collector.

The sodium sulfide is hydrolyzed in solution and then dissociates as indicated by the following reactions:

$$NaS + 2H_2O \longleftrightarrow 2NaOH + H_2S$$

$$NaOH \longleftrightarrow Na^+ + OH^-$$

$$H_2S \longleftrightarrow H^+ + HS^-$$

$$HS^- \longleftrightarrow H^+ + S^{2-}$$

In these equations, the concentration of the $OH^-$ ions increases more rapidly than the concentration of the $H^+$ ions, so that the pulp is made more alkaline. The $OH^-$, $S^{2-}$ and $HS^-$ ions react with the mineral surfaces, modifying them. The sulfurization results in the sulfur ions passing into the crystalline lattice of the oxidized minerals, imparting to them a surface covering of pseudosulfides and permitting them to be floated by the mercapto collectors.

HYDROGEN PEROXIDE COMPONENT

Hydrogen peroxide ($H_2O_2$) can also be considered a modifying reagent, but with less known uses.

Among the applications which can be mentioned there is its use in operations of selective flotation of copper and molybdenum minerals. In this case, in an acid conditioning environment, it is used to assist in the depression of copper in the molybdenum flotation stage. The peroxide (fed in 50% solution) serves to transform the water-soluble mercapto collectors into insoluble substances.

Since pure hydrogen peroxide is not usually available or easily prepared, the physical constants of aqueous solutions are of greater practical value than those of pure peroxide. In any event, it may be mentioned that the stability of hydrogen peroxide depends on the degree to which it is purified. For a very pure peroxide, the decomposition is as little as 0.0008% to 0.0002% per hour at 50° C. Various factors appear to influence the decomposition of the peroxide, such as the temperature, the presence of certain suspended materials, the pH, and the radiation. The hydroxide ions cause rapid decomposition of the hydrogen peroxide. The effect of the pH has been thoroughly studied, establishing an optimum stability for a pH of 4.

There are two possible structures of hydrogen peroxide: The symmetric (I or III) and the asymmetric (II). In accordance with its chemical behavior, the symmetric structures appear to be more probable although, under certain conditions such as very low temperatures, the asymmetric structure can be expected.

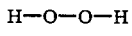

(I)

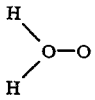

(II)

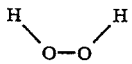

(III)

SODIUM BICARBONATE COMPONENT

Sodium bicarbonate ($NaHCO_3$) can also be considered a modifying reagent, although there are no major examples of its use in flotation.

The bicarbonate is decomposed at moderate temperatures, it starting to lose carbon dioxide at about 50° C., being essentially sodium carbonate ($Na_2CO_3$) above 100° C. Furthermore, it is easily decomposed in the presence of weak acids. Since the bicarbonate is a pharmaceutical product, it has strict purity specifications, with concentrations of 99.8% to 99.9% for its marketing.

Sodium carbonate or soda ash ($Na_2CO_3$) is more related to flotation. When the gangue tailings constitute a serious problem, soda ash can be effective in order to improve both the assay of the concentrate and the recovery.

COMPOSITION OF THE REAGENT OF THE INVENTION

The composition of the reagent of the present invention is prepared by using sufficient amounts of the four components indicated, namely (a) pine oil, (b) $Na_2S$, (c) $H_2O_2$ and (d) $NaHCO_3$ in order to prepare an activator-frother reagent of good selectivity for use in processes of flotation of sulfide type minerals.

The amounts of each component used advantageously to prepare the composition of this reagent of the invention will vary, depending on the components (a), (b), (c) and (d) used, the specific ore which is being treated, and the desired systems of recovery and selectivity.

The composition is comprised of, by weight, approximately 1% to 10%, and preferably 2% to 8% of component (a) approximately 10% to 30%, and preferably 12% to 20% of component (b) in 10% solution, approximately 15% to 36%, and preferably 22% to 34%, of component (c) in 50% solution, and approximately 20% to 40%, and preferably 25% to 38%, of component (d).

Even more preferably, the composition of the activator-frothing reagent of the invention comprised of by weight of approximately 3% to 7% of component (a), approximately 13% to 18% by weight of component (b), approximately 25% to 33% of component (c), and approximately 26% to 34% of component (d).

A few examples of the new composition of the invention are indicated below, they being intended merely to serve as illustration without constituting any limitation.

EXAMPLES OF APPLICATION

MINERAL USED

The behavior of the reagent of the invention has been tested basically on the recovery of copper from flotation plant tailings, the sulfide chalcopyrite being the predominant copper mineral. Analysis of the copper content by granulometric fraction carried out in the S.G.S. Chile Laboratory is indicated below:

| SIZE | | COPPER | |
|---|---|---|---|
| MESCH (#) | (%) | ASSAY (% Cu) | DISTRIB. (%) |
| + 150 | 29.6 | 0.14 | 22.6 |
| −150 + 180 | 7.5 | 0.12 | 4.9 |
| −180 + 200 | 5.8 | 0.12 | 3.8 |
| − 200 | 57.1 | 0.22 | 68.7 |
| TOTAL | 100.0 | 0.18 | 100.0 |

The objective intended with the use of the reagent of the invention was directed at obtaining high recoveries in the obtaining of a preconcentrate or primary concentrate, and furthermore one which had assays compatible with those which it requires as feed for a conventional flotation circuit, i.e. with values on the order of 1.0% copper or more.

EXAMPLE NO. 1

Tailings having the characteristics indicated above were processed in cascade type installations, consisting in passing the tailing through a series of falls which are equally spaced from each other in order to produce frothing. The reagent of the invention was applied in the feed to the system, subsequent to the adjustment of the pH by the addition of lime.

The samples of concentrate were obtained for four doses of the reagent of the invention, for which the froth was collected for a period of 10 minutes after each fall. The concentrates were conducted to an alternate channel and were then dried, weighed and sent for chemical analysis. The results obtained are indicated below.

| | REAGENT | | COPPER CONCENTRATE | |
|---|---|---|---|---|
| TEST | (g/ton) | pH | ASSAY (% Cu) | RECOVERY |
| 1 | 400 | 6.5 | 3.20 | 90.0 |
| 2 | 300 | 6.5 | 2.80 | 85.0 |
| 3 | 200 | 6.5 | 1.75 | 75.0 |
| 4 | 100 | 6.5 | 1.20 | 60.0 |

EXAMPLE NO. 2

The same tailing as indicated above was processed in a single flotation cell having a capacity of 3.86 $m^3$ with conventional agitator mechanism but increasing its speed to 2000 rpm. In this case, the results obtained as a function of the dose of the reagent of the invention were as follows:

| | REAGENT | | COPPER CONCENTRATE | |
|---|---|---|---|---|
| TEST | (g/ton) | pH | ASSAY (% Cu) | RECOVERY |
| 1 | 200 | 6.5 | 4.20 | 91.0 |
| 2 | 150 | 6.5 | 3.44 | 82.3 |
| 3 | 100 | 6.5 | 1.76 | 68.0 |
| 4 | 50 | 6.5 | 0.82 | 40.0 |

I claim:

1. A activator frother composition of good selectivity which can be employed as additional reagent for the flotation of minerals of finely divided sulfide and as sole reagent for the retreatment flotation tailings, comprising:

a) approximately 1% to 10% by weight of said composition being comprised of pine oil;

b) approximately 10% to 30% by weight of said composition being comprised of sodium sulfide ($Na_2S$) in 10% solution;

c) approximately 15% to 36% by weight of said composition being comprised of hydrogen peroxide ($H_2O_2$) in 50% solution; and d) approximately 20% to 40% by weight of said composition being comprised of sodium bicarbonate ($NaHCO_3$) in 20% solution.

2. The activator-frother composition of claim 1, wherein it contains 3 to 7% by weight of pine oil.

3. The activator-frother composition of claim 1, wherein it contains 13% to 18% by weight of sodium sulfide.

4. The activator-frother composition of claim 1, wherein it is comprised of 25% to 33% by weight of hydrogen peroxide ($H_2O_2$) in 50% solution.

5. The activator-frother composition of claim 1, wherein it is comprised of 26% to 34% by weight of sodium bicarbonate ($NaHCO_3$) in 20% solution.

6. The activator-frother composition of claim 1, wherein it contains 2 to 8% by weight of pine oil.

7. The activator-frother composition of claim 1, wherein it contains 12 to 20% by weight of sodium sulfide in 10% solution.

8. The activator-frother composition of claim 1, wherein it contains 22 to 34% by weight of hydrogen peroxide in 50% solution.

9. The activator-frother of claim 1, wherein it is comprised of 25 to 38% by weight of sodium bicarbonate ($NaHCO_3$) in 20% solution.

* * * * *